United States Patent [19]

Tsutsui et al.

[11] Patent Number: 4,516,849

[45] Date of Patent: May 14, 1985

[54] CLEANING DEVICE FOR AN ELECTROSTATIC PHOTOGRAPHIC COPYING MACHINE

[75] Inventors: Eiji Tsutsui, Amagasaki; Masahiro Yoshioka; Masahiro Murakami, both of Osaka; Noriyuki Iwao, Kobe, all of Japan

[73] Assignee: Mita Industrial Co., Ltd., Osaka, Japan

[21] Appl. No.: 476,373

[22] Filed: Mar. 17, 1983

[30] Foreign Application Priority Data

Apr. 4, 1982 [JP] Japan ..... 57-56455

[51] Int. Cl.[3] ..... G03G 15/08

[52] U.S. Cl. ..... 355/15; 118/652

[58] Field of Search ..... 355/15, 3 DD, 14 D, 355/3 R; 118/657, 658, 653, 652; 430/125

[56] References Cited

U.S. PATENT DOCUMENTS 3,552,848 1/1971 Van Wagner ..... 355/15 X
3,809,012 5/1974 Delvecchio ..... 118/657 X
3,917,398 11/1975 Takahashi et al. .
4,140,388 2/1979 Ikesue .
4,213,617 7/1980 Salger ..... 355/3 DD X

OTHER PUBLICATIONS

Freeman et al., "Spring Loaded Seal", *IBM Technical Disclosure Bulletin,* vol. 17, No. 3, Aug., 1974.

*Primary Examiner*—A. C. Prescott
*Attorney, Agent, or Firm*—Wenderoth, Lind & Ponack

[57] ABSTRACT

A cleaning device for an electrostatic photographic copying machine having a sensitive drum provided with a paper-stripping groove at one side thereof includes an upper blade for stripping residual toner from the sensitive drum, a lower blade for guiding the thus stripped toner from the surface of the sensitive drum toward a toner withdrawing device, and a groove cover covering the paper-stripping groove at least from the upper blade to the lower blade so that the groove cover will be in contact with the lower blade. Residual toner which is stripped from the surface of the sensitive drum is prevented from entering the paper stripping groove by the groove cover.

14 Claims, 6 Drawing Figures

CLEANING DEVICE FOR AN ELECTROSTATIC PHOTOGRAPHIC COPYING MACHINE

BACKGROUND OF THE INVENTION

1. Field of the Invention

The present invention relates to a cleaning device for an electrostatic photographic copying machine of the type including a sensitive drum provided at one side thereof with a paper-stripping groove, an upper blade in contact with the sensitive drum for stripping residual toner therefrom, and a lower blade in contact with the sensitive drum at a position upstream from the upper blade in the rotary direction of the sensitive drum for guiding stripped toner toward a toner withdrawing device.

2. Description of the Prior Art

Although a cleaning device which strips and withdraws residual toner from the surface of a sensitive drum by means of upper and lower blades is known, copying machines with such cleaning devices have not been provided with a paper-stripping groove provided at one or both sides of the sensitive drums. Thus, although this paper-stripping groove is important for stripping an imaged copy paper sheet from the sensitive drum by means of a stripping member extending into such groove, when the machine includes such a cleaning device this groove leads to a disadvantage that residual toner which is stripped by means of the upper blade enters the paper-stripping groove and then falls downwardly without being guided toward the toner withdrawing device by means of the lower blade. Toner which thus falls downwardly without being withdrawn leads not only to adhesion thereof to a transporting means, a driving means and the like, but also to the adhesion of such toner to the surface of copy paper sheet or to the reverse side of the following copy paper sheet through a roller, thus seriously impairing the quality of copying.

In particular, the above described disadvantages is even more remarkably produced when the upper blade periodically slides in the direction of the rotary axis of the sensitive drum in order to securely strip residual toner, since a large amount of such stripped toner then enters the paper-stripping groove.

SUMMARY OF THE INVENTION

The present invention was made taking notice of the above described disadvantages incidental to the conventional devices. Thus, it is an object of the present invention to provide a cleaning device for an electrostatic photographic copying machine, whereby it is possible to prevent residual toner from entering a paper-stripping groove after being stripped. Thereby, disadvantageous influences of the stripped toner upon other portions of the machine can be prevented, and as a result high quality copying can be secured.

BRIEF DESCRIPTION OF THE DRAWINGS

The accompanying drawings show preferred embodiments of a cleaning device for an electrostatic photographic copying machine according to the present invention, and in which.

DESCRIPTION OF THE PREFERRED EMBODIMENTS

Figure 1:
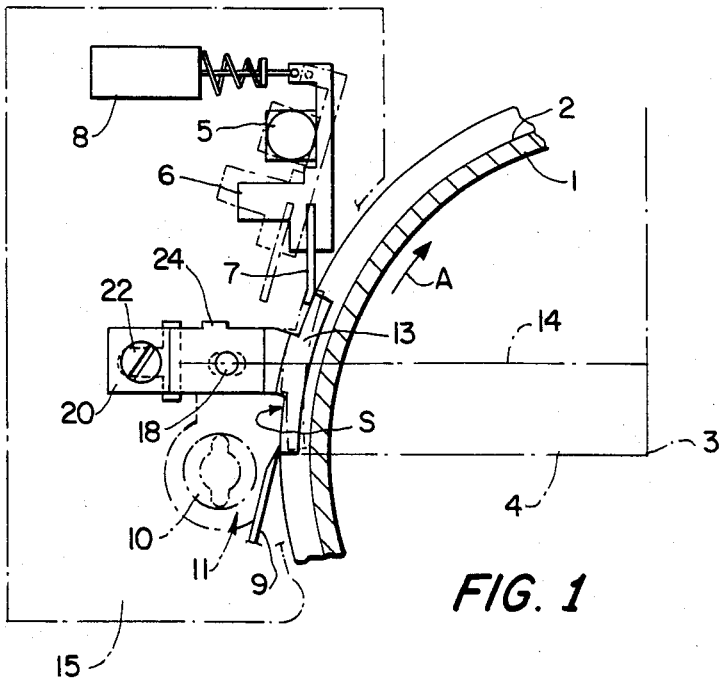
FIG. 1 is a front view of a device according to the invention, with a portion of a drum shown in cross section.
Figure 2:
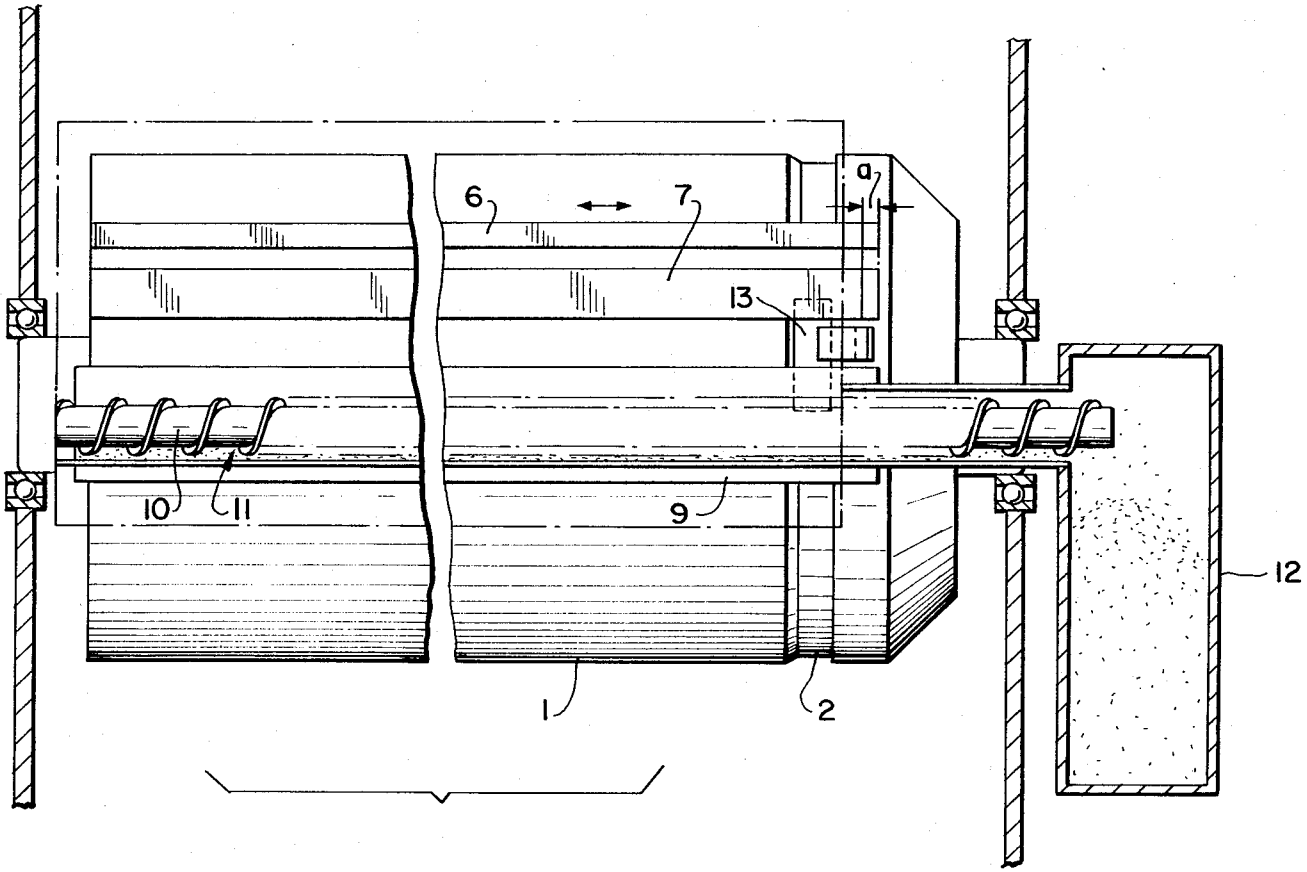
FIG. 2 is a partial side view.

The embodiments of the present invention will be described in detail below with reference to the drawings. Referring now to FIGS. 1, 2, a sensitive drum is provided with a paper-stripping groove 2 at one side thereof (at both sides thereof if necessary) and has an external surface coated with sensitive material. Sensitive drum 1 is rotatably drive in the direction of arrow A by means of a driving device (not shown) about a rotary axis 3. A shaft 5 is installed to reciprocate through a predetermined angle about an axis parallel to rotary axis 3 above a horizontal line 4 passing through rotary axis 3.

An upper blade 7 for stripping residual toner and made of an elastic material such as urethane rubber is detachably mounted on the lower end of a holding frame 6 fixedly mounted on shaft 5. A solenoid 8 is connected with the upper end of holding frame 6 so that a pointed lower end of upper blade 7 will be moved will be moved into contact with sensitive drum 1 when solenoid 8 is excited during a cleaning operation, as shown by the solid lines in FIG. 1, while blade 7 periodically is caused to slide by a distance a (FIG. 2) in the direction of rotary axis 3 by means of the suitable structure (not shown) to strip residual toner from the surface of sensitive drum 1. Upper blade 7 is separated from sensitive drum 1, as shown by the phantom lines in FIG. 1, when solenoid 8 is demagnetized during operations other than cleaning.

A lower blade 9 for guiding toner likewise is made of an elastic material such as urethane rubber and is positioned upstream of blade 7, in the rotary direction of sensitive drum 1, so that a pointed upper end of blade 9 will be in contact with sensitive drum 1 at a position slightly above horizontal line 4.

Toner stripped by means of upper blade 7 is guided into a toner-withdrawing portion 11 provided with a screw conveyor 10 by means of lower blade 9 and then is transferred into a withdrawing tank 12 (FIG. 2) by means of screw conveyor 10.

A groove cover 13, made of for example a resin such as "Duracon", covers paper-stripping groove 2 from upper glade 7 to lower blade 9 so that the pointed ends of upper blade 7 and lower blade 9 will be in contact with the surface of groove cover 13. Accordingly, residual toner stripped by means of upper blade 7 will be prevented from entering paper-stripping groove 2 and thereby will be prevented from falling downwardly through groove 2. Further, although in this embodiment the pointed ends of not only lower blade 9 but also of upper blade 7 are in contact with the surface of groove cover 13, it is not always required that the pointed end of upper blade 7 be in contact with groove cover 13.

As shown in FIG. 1, groove cover 13 is mounted on a fixed side plate 15 so as to be movable along a line 14 substantially parallel to horizontal line 4 passing through rotary axis 3 of sensitive drum 1 or to be fixed.

The surface S of groove cover 13 may be formed in almost complete correspondence to the surface of sensitive drum 1 by transferring groove cover 13 along line 14.

As to the adjustment of groove cover 13, various modifications are possible. As shown for example in FIG. 3, groove cover 13 may be mounted for movement along a line 16 passing through rotary axis 3 of sensitive drum 1. That is to say, groove cover 13 may be installed to be slidable in the radial direction with respect to rotary axis 3 of sensitive drum 1 so that the position of groove cover 13 may be adjusted or fixed.

Groove cover 13 preferably is installed so that the line of adjustment will be positioned at almost the center between the point of contact of the pointed end of upper blade 7 with sensitive drum 1 and the point of contact of the pointed end of lower blade 9 with sensitive drum 1. However, in the arrangement shown in FIG. 3, groove cover 13 must be transferred along line 16 passing through rotary axis 3, and control of this centering is somewhat difficult. On the contrary, in the arrangement shown in FIG. 1, such centering control is easy, whereby such arrangement is more practical than that shown in FIG. 3.

Figure 3:
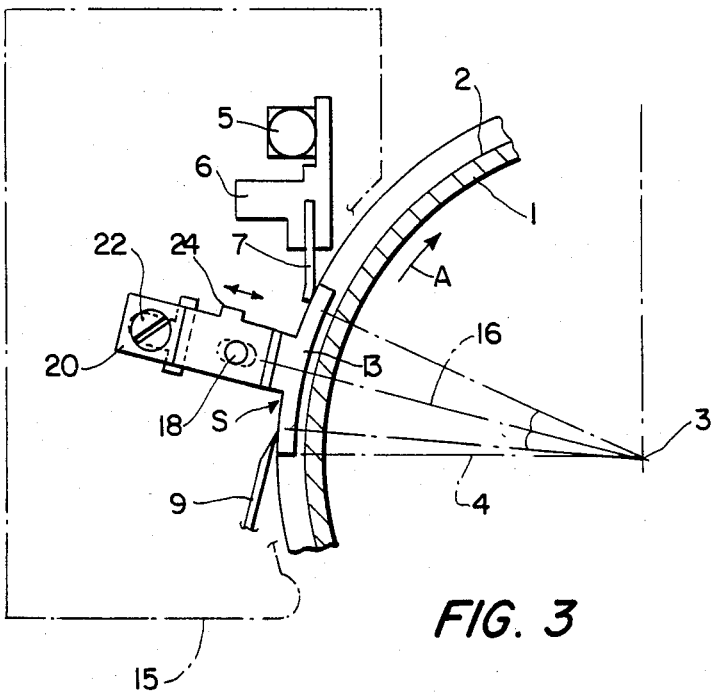
FIG. 3 is a front view similar to FIG. 1 but showing another embodiment.

Surface S of groove cover 13 will be moved out of alignment with the surface of sensitive drum 1 when the sliding direction is deviated from radial line 16 in the embodiment of FIG. 3, or from line 14 in the embodiment of FIG. 1. However, groove cover 13 can be rotated around the axis of a shaft or pin 18 by an angle necessary to correct the posture or alignment thereof, by means of cover installing construction which will be described later. That is to say, as shown by the phantom lines in FIG. 1, the pointed end of said upper plate 7 moves groove cover 13 about pin 18 so as to be in contact with sensitive drum 1 even if surface S of groove cover 13 tends to rise above the surface of sensitive drum 1, or if groove cover 13 so moves with the separation of upper blade 7 from sensitive drum 1 by demagnetizing solenoid 8. Thereby, surface S of groove cover 13 can be corrected in posture to be in alignment with the surface of sensitive drum 1.

Figure 4:
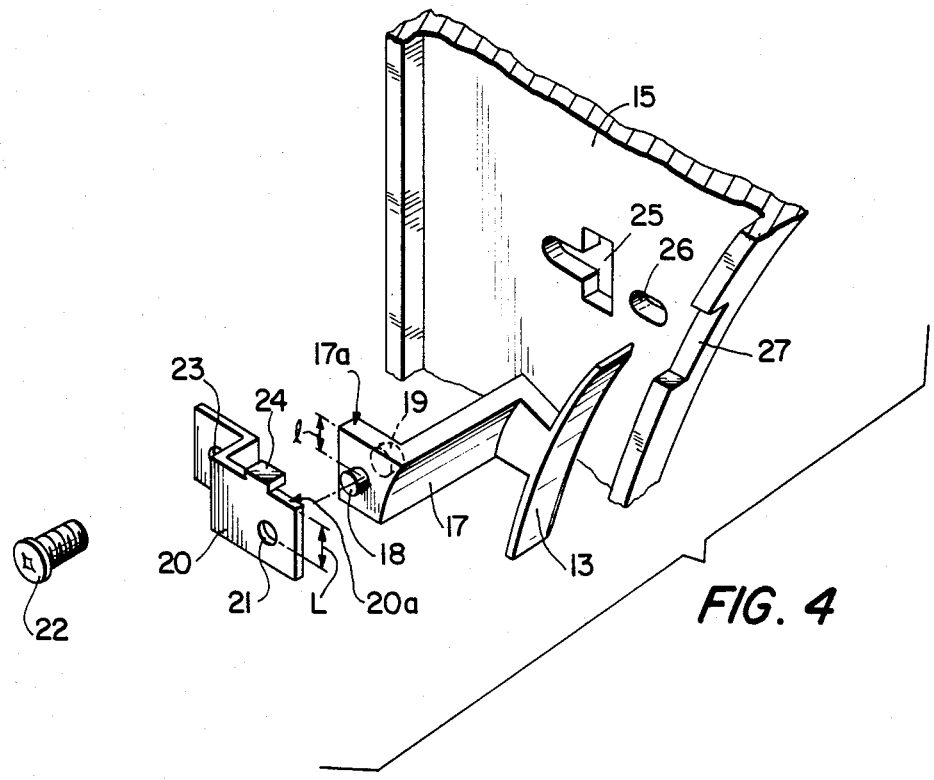
FIG. 4 is a perspective exploded view showing the essential parts of the device.
Figure 5:
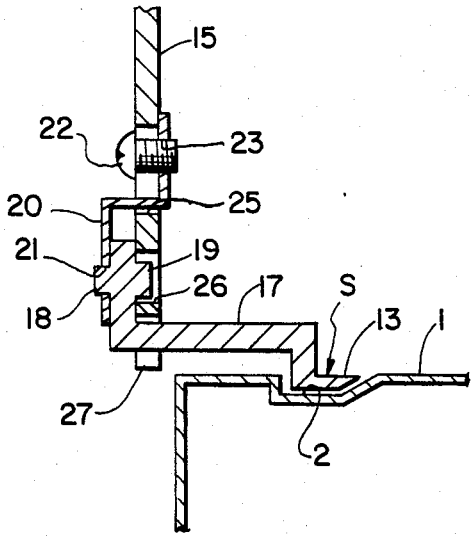
FIG. 5 is a side view of the device in cross section and showing the essential parts assembled.

The structure for mounting groove cover 13 on a fixed side plate 15 now will be described with reference to FIGS. 4, 5. Groove cover 13 is integrally formed with an L-shaped member 17 provided with coaxial pins 18, 19 fixedly extending from opposite sides of one arm or end thereof. An L-shaped lock plate 20 has at one end thereof a hole 21 supporting pin 18 and at another end thereof a threaded hole 23 for threaded engagement of a screw 22. Plate 20 has a stopper 24 which engages with an upper surface 17*a* of member 17 for controlling the rotation of member 17 and groove cover 13 relative to plate 20. The distance L between the axis of hole 21 and an upper surface 20*a* of plate 20 is slightly larger than the distance l between the axis of pin 18 and upper surface 17*a* of member 17. Thus, adjustment of the orientation or posture about the axis of pin 18 is possible. On the other hand, a part of plate 20 is inserted through side plate 15 so as to be arranged in the opposite side thereof from the remainder of plate 20. Thus, side plate 15 is provided with a T-shaped opening 25 for receipt therethrough of an arm of plate 20 and of screw 22, an elongated hole 26 for receipt of pin 19 and a notch 27.

Groove cover 13 is installed on fixed side plate 15 by extending the end portion including threaded hole 23 of lock plate 20 through opening 25 of fixed side plate 15, with pin 18 of member 17 received in hole 21 of lock plate 20, and then inserting pin 19 into elongated hole 26 of fixed side plate 15, while engaging member 17, which is integrally formed with groove cover 13, into notch 27. Thereby, the positioning of groove cover 13 about the axis of pin 18 can be satisfactorily carried out, and then screw 22 is inserted and tightened. After installing groove cover 13 in this manner the position of groove cover 13 then can be adjusted to align with paper-stripping groove 2 by slightly loosening screw 22, moving groove cover 13 along line 14 or line 16, and then tightening screw 22 again. The extent of such movement is defined by opposite ends of hole 26. Also, the difference in dimensions L and l allows slight pivoting of member 17 and cover 13 about the axis of pins 18, 19 with respect to plate 20.

Figure 6:
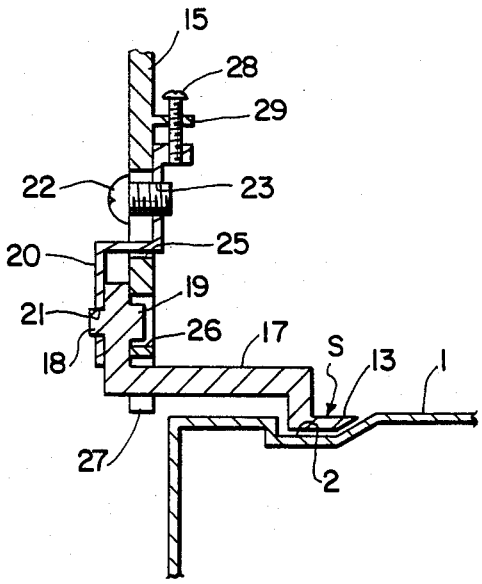
FIG. 6 is a side view similar to FIG. 1 showing the essential parts assembled of still another embodiment.

However, as shown in FIG. 6, a fine regulation screw 28 may be mounted to act on the end portion of lock plate 20. Fine regulation screw 28 is screwed into and through member 29 protruding from the reverse side of fixed side plate 15. Thereby, the regulation of adjustment of groove cover 13 is facilitated.

As described above, a cleaning device for an electrostatic photographic copying machine according to the present invention is provided with a groove cover which covers a paper-stripping groove in a sensitive drum, at least from an upper blade to a lower blade, so that the groove cover may be in contact with the lower blade. Accordingly, residual toner stripped from the sensitive drum by means of the upper blade will be prevented from entering the paper-stripping groove by the groove cover. Thus, this residual toner can be prevented from falling downwardly through the paper-stripping groove, from adhering to, for example, a transporting means and a driving means, and from falling onto the surface of a copy paper sheet after the transference thereto of a toner imate. As a result, the disadvantages incidental to conventional cleaning devices can be eliminated.

What is claimed is:

1. A cleaning device for use in an electrostatic photographic copying machine of the type including a sensitive drum rotatable about an axis and provided at one axial end with an annular paper-stripping groove, for removing residual toner from the surface of the drum, said cleaning device comprising:

an upper blade mounted to contact the drum to strip therefrom residual toner;

a lower blade mounted below said upper blade and upstream thereof in the rotary direction of the drum for guiding the stripped residual toner to a toner withdrawal device; and means for preventing the stripped toner from entering the paper-stripping groove, said means comprising a groove cover mounted to extend into and cover the paper-stripping groove at least from the position of contact of said upper blade with the drum to the position of contact of said lower blade with the drum, said groove cover being in contact with said lower blade.

2. A device as claimed in claim 1, further comprising means for mounting said groove cover for sliding adjustment in opposite directions parallel to a horizontal line extending transverse to the rotational axis of the drum.

3. A device as claimed in claim 1, further comprising means for mounting said groove cover for sliding adjustment in opposite directions radially of the drum.

4. A device as claimed in claim 1, further comprising means for mounting said groove cover for relative movement in directions toward and away from the paper-stripping groove, said mounting means comprising a member extending laterally of said groove cover, said member having a first end integral with said groove cover and a second end having extending therefrom a first pin having an axis parallel to the axis of the drum, a fixed side plate having therein an elongated hole, said first pin fitting into said hole for selective movement along the length thereof, and means for fixing said member to said fixed side plate with said first pin positioned at a selected position along the length of said elongated hole.

5. A device as claimed in claim 4, wherein said fixing means comprises a plate fixed adjustably to said fixed side plate and having therethrough a pivot hole, said second end of said member having extending therefrom a second pin opposite to said first pin and coaxial therewith, said second pin fitting into said pivot hole, said second end of said member being positioned between said plate and said fixed side plate and pivotable with respect thereto about colinear axes of said first and second pins.

6. A device as claimed in claim 5, further comprising a stopper extending from said plate for abutment with said second end of said member to limit pivoting movement of said member relative to said plate.

7. A device as claimed in claim 5, wherein said fixed side plate has therethrough a T-shaped opening, said plate includes a portion extending through said opening, and further comprising a bolt extending through said opening and adjustably fixing said plate to said fixed side plate.

8. In an electrostatic photographic copying machine of the type including a sensitive drum rotatable about an axis and provided at one axial end with an annular paper-stripping groove, and a cleaning device for removing residual toner from the surface of said drum, the improvement wherein said cleaning device comprises:

an upper blade mounted to contact said drum to strip therefrom residual toner;

a lower blade mounted below said upper blade and upstream thereof in the rotary direction of said drum for guiding the stripped residual toner to a toner withdrawal device; and means for preventing the stripped toner from entering said paper-stripping groove, said means comprising a groove cover mounted to extend into and cover said paper-stripping groove at least from the position of contact of said upper blade with said drum to the position of contact of said lower blade with said drum, said groove cover being in contact with said lower blade.

9. The improvement claimed in claim 8, further comprising means for mounting said groove cover for sliding adjustment in opposite directions parallel to a horizontal line extending transverse to the rotational axis of said drum.

10. The improvement claimed in claim 8, further comprising means for mounting said groove cover for sliding adjustment in opposite directions radially of said drum.

11. The improvement claimed in claim 8, further comprising means for mounting said groove cover for relative movement in directions toward and away from said paper-stripping groove, said mounting means comprising a member extending laterally of said groove cover, said member having a first end integral with said groove cover and a second end having extending therefrom a first pin having an axis parallel to said axis of said drum, a fixed side plate having therein an elongated hole, said first pin fitting into said hole for selective movement along the length thereof, and means for fixing said member to said fixed side plate with said first pin positioned at a selected position along the length of said elongated hole.

12. The improvement claimed in claim 11, wherein said fixing means comprises a plate fixed adjustably to said fixed side plate and having therethrough a pivot hole, said second end of said member having extending therefrom a second pin opposite to said first pin and coaxial therewith, said second pin fitting into said pivot hole, said second end of said member being positioned between said plate and said fixed side plate and pivotable with respect thereto about colinear axes of said first and second pins.

13. The improvement claimed in claim 13, further comprising a stopper extending from said plate for abutment with said second end of said member to limit pivoting movement of said member relative to said plate.

14. The improvement claimed in claim 13, wherein said fixed side plate has therethrough a T-shaped opening, said plate includes a portion extending through said opening, and further comprising a bolt extending through said opening and adjustably fixing said plate to said fixed side plate.

* * * * *